United States Patent [19]

Otsubo et al.

[11] 3,986,353

[45] Oct. 19, 1976

[54] SECONDARY AIR PRESSURE CONTROL VALVE

[75] Inventors: Kizuku Otsubo, Kokubunji; Hiraki Sawada, Seki, both of Japan

[73] Assignee: Nissan Motor Co., Ltd., Yokahama, Japan

[22] Filed: Sept. 24, 1974

[21] Appl. No.: 508,831

[30] Foreign Application Priority Data

Sept. 28, 1973 Japan ..... 48-109469

[52] U.S. Cl. ..... 60/290; 251/61.4

[51] Int. Cl.[2] ..... F01N 1/14; G05D 9/00; F01N 3/00

[58] Field of Search ..... 251/61, 61.1, 61.2, 251/61.3, 61.4, 61.5, 63.4, 77, 79, 80, 82, 83, 157; 60/290, 377

[56] References Cited

UNITED STATES PATENTS

| | | | |
|---|---|---|---|
| 1,232,352 | 7/1917 | MacVicar | 251/80 |
| 1,394,756 | 10/1921 | Mueller et al. | 251/80 |
| 2,007,569 | 7/1935 | Hoke | 251/80 |
| 2,695,766 | 11/1954 | Peltz | 251/77 |
| 3,106,820 | 10/1963 | Schaffer et al. | 60/290 |
| 3,430,437 | 3/1969 | Saussele | 60/290 |
| 3,477,466 | 11/1969 | Sturm | 251/63.4 |
| 3,479,816 | 11/1969 | Masters | 60/290 |
| 3,520,320 | 7/1970 | Crawford et al. | 60/290 |
| 3,618,891 | 11/1971 | Topfer et al. | 251/63.4 |

FOREIGN PATENTS OR APPLICATIONS

| | | | |
|---|---|---|---|
| 932,592 | 9/1955 | Germany | 251/63.4 |

*Primary Examiner*—Martin P. Schwadron
*Assistant Examiner*—George L. Walton

[57] ABSTRACT

A pressure control valve for venting excess air pressure in a secondary air supply conduit opening to an exhaust system of an internal combustion engine has a relief valve member to close a vent port through which excess air pressure in the secondary air supply conduit is vented. The valve member is directly operable in response to excess pressure in the secondary air supply conduit. This valve member is fixedly secured to one end of a stem slidably extending through a spring seat. The stem has at its opposite end a flange and a coil spring is compressed between the spring seat and the flange to urge the relief valve to its vent port closing position. The spring seat is spring biased in a direction toward the flange to increase compression of the coil spring and it is also moved in the opposite direction in response to intake manifold vacuum by means of a vacuum servo to reduce compression of the coil spring. When the intake manifold is higher than a predetermined magnitude, as during deceleration of the engine, the vacuum servo causes the valve member to remain opened, so that substantially all air in the secondary air supply conduit may be vented. The vacuum servo has a diaphragm dividing an enclosing casing into first and second chambers, respectively, on the opposite sides thereof, the first chamber being exposed to ambient atmospheric air, the second chamber being connected to the intake system. The spring seat is disposed in the second chamber and is fixed to the diaphragm. The vacuum servo has also a spring disposed in the second chamber to bias the diaphragm to urge the spring seat in a direction toward the flange to cause an increase compression of the coil spring.

4 Claims, 1 Drawing Figure

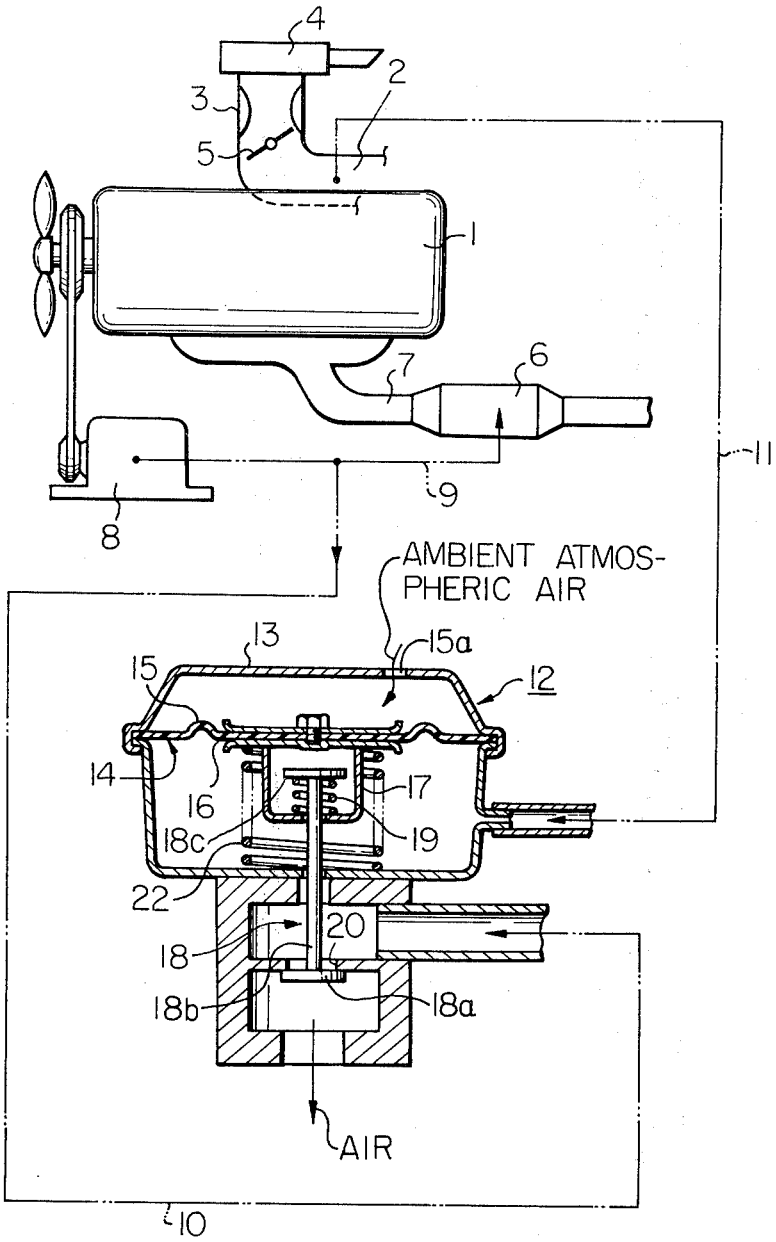
4
2
3
5
1
7
6
11
9
8
AMBIENT ATMOS-
PHERIC AIR
13
15a
15
12
14
16
17
18c
19
22
20
18
18b
18a
AIR
10

SECONDARY AIR PRESSURE CONTROL VALVE

The present invention relates to a secondary air control valve.

It has been a promising practice, to reduce concentrations of HC and CO in exhaust gas from an internal combustion engine, to provide an exhaust gas purifier of the type that oxidizes exhaust gases using secondary air. To optimize the amount of secondary air mixed with the exhaust gas, a control valve is provided to control pressure, within a secondary air supply pipe, which is delivered from an air pump.

A typical conventional control valve is a pressure responsive relief valve which releases excessive air from the secondary air pipe supply conduit when pressure exceeds a predetermined level. With this type of control valve, however, supply of air to the exhaust gas purifier becomes excessive during deceleration and light load operations, and scarce during heavy load operations. Incomplete oxidation of HC and CO during after burning is thus likely to result.

One object of the invention is to provide a pressure control valve which can control pressure of secondary air such that the supply to the exhaust gas purifier is optimized throughout all engine operating conditions.

Another object of the present invention is to provide a pressure control valve which can control pressure of secondary air responsive to engine load.

The above and other objects, features, and advantages of the present invention will become apparent from the following description taken in connection with the accompanying drawing, in which:

The FIGURE is a schematic sectional view of a secondary air pressure control valve according to the invention installed in a secondary air supply system of an internal combustion engine.

Reference is now made to the drawing, which shows one embodiment of the present invention.

In the FIGURE, there is shown an internal combustion engine 1 having an intake manifold 2 provided with a venturi 3 to draw in ambient air via an air cleaner 4 under the control of a throttle valve 5, and an exhaust pipe 7.

An exhaust gas purifier 6 is disposed in exhaust pipe 7 to which secondary air is fed from an air pump 8 through a secondary air supply pipe conduit 9. The air pump 8 is driven off the engine crankshaft. An air vent conduit 10 branches off from the secondary air supply pipe 9. Mounted to the air vent conduit is the secondary air control valve 12 embodying the invention.

The secondary air control valve 12 comprises a vacuum servo in the form of a diaphragm 14 clamped between the upper and lower parts of a casing 13. The diaphragm 14 is connected to the intake manifold vacuum on the spring loaded side 16 thereof and has a atmospheric side 15 exposed to ambient atmospheric air through a vent port 15*a*. Vacuum pipe 11 provides a connection between intake manifold 2 downstream of throttle valve 5 and the spring loaded side 16 of diaphragm 14 so that the diaphragm 14 deflects in response to the intake manifold vacuum. Designated by a reference numeral 18 is a spring-urged pressure relief valve to control the air vent. The relief valve 18 is urged to its vent port closing position in response to the magnitude of the intake manifold vacuum, in such a manner that the force increases during heavy load operation and decreases during light load operation. A bell-shaped spring seat 17 is secured to the spring loaded side 16 of the diaphragm 14. Slidably extending through the bell-shaped spring seat is a valve stem 18*b* secured at one end to a valve member or head 18*a* of the pressure relief valve 18 and at its opposite end a flange 18*c*. A valve spring in the form of a coil spring 19 is compressed between the bottom of the spring retainer and the flange, as shown, to urge the valve member 18*a* to its vent port closing position, a vent port being designated by a reference numeral 20. It will be understood that the bell-shaped spring seat is spring biased upwardly by means of a diaphragm spring 22 toward the flange 18*c* to increase compression of the coil spring 19 and the diaphragm 14 moves the bell-shaped spring seat 17 downwardly in the opposite direction away from the flange 18*c* to reduce compression of the coil spring 19 responsive to increases in intake manifold vacuum. It will be seen that the deflection of diaphragm 14 due to intake manifold signal causes the valve closing force to be reduced because the valve spring 19 relaxes on downward deflection of diaphragm 14.

The valve member 18*a* is directly operable in response to excess pressure in the secondary air supply conduit 9 and has an effective area exposed to air pressure in the secondary air supply conduit 9. The valve member 18*a* is opened when the valve opening force derived from the air pressure acting on the effective area of the valve member 18*a* exceeds the valve closing force derived from the compression of the coil spring 19, the compression of the coil spring 19 decreasing as the intake manifold vacuum applied to the spring loaded side 16 increases. It is to be noted that the diaphragm 14 will not come into contact with the flange 18*c* in aiding the opening of the valve member 18*a*. When the intake manifold vacuum increases above a predetermined magnitude, as during deceleration of the engine 1, the diaphragm 14 moves downwardly to keep the valve member 18*a* in the valve opening position, so that substantially all secondary air will bleed off through the valve 18.

During heavy load operation of the engine, intake manifold vacuum is relatively low, so the valve closing force is higher than that during light load operation. Thus substantially all air delivered by air pump 8 will be fed into the exhaust gas purifier 6 because the valve closing force becomes high enough to withstand the increased air pressure in the secondary air supply pipe 9. The rate of air delivered from air pump 8 is substantially proportional to engine r.p.m. During light load operation of the engine, however, the valve closing force decreases intake manifold vacuum is relatively high and causes downward deflection of diaphragm 14. Thus the secondary air fed to exhaust gas purifier 6 is reduced. During deceleration the valve 18 permits substantially all secondary air to bleed off.

It will be seen that valve closing force of the relief valve 18 increases as engine load increases, and thus the rate of air fed to the exhaust gas purifier 6 increases as the load increases.

Should excessively high pressure develop in the secondary air supply pipe, the valve 18 opens due to force applied thereon and allows excessive air pressure to bleed off. Thus it will be appreciated that the control valve 12 prevents the air pump 8 from being subjected to unnecessary heavy loads and prolongs the life of same.

From the preceding description it will be appreciated that with the control valve 12 of the invention the flow of secondary air becomes a function of engine load or intake manifold vacuum.

What is claimed is:

1. In a secondary air injection apparatus for an internal combustion engine having an intake system and an exhaust system, said apparatus including a secondary air supply conduit communicating with the exhaust system to inject secondary air thereinto and an air pump discharging secondary air under pressure into the secondary air supply conduit, a secondary air pressure control valve comprising:

means defining a vent port through which excess air pressure in the secondary air supply conduit is selectively vented to the atmosphere;

a relief valve member to close the vent port, said relief valve member being responsive to air pressure in said secondary air supply conduit and having an effective area exposed to the air pressure in said secondary air supply conduit to open the vent port;

a spring seat;

a stem slidably extending through said spring seat, the stem being secured at one end thereof to the relief valve member and having a flange at opposite end thereof;

a coil spring compressed between said spring seat and said flange to urge said relief valve member to its vent port closing position;

said spring seat being spring biased by another spring in a direction toward said flange to increase compression of said coil spring; and vacuum servo means connected to the intake system and reducing compression of the coil spring in response to increases in intake manifold vacuum when the intake vacuum is lower than a predetermined value and for leaving the relief valve member in a position to open the vent port when the intake manifold vacuum is higher than the predetermined value.

2. In a secondary air injection apparatus for an internal combustion engine having an intake system and an exhaust system. Said apparatus including a secondary air supply conduit communicating with the exhaust system to inject secondary air thereinto and an air pump discharging secondary air under pressure into the secondary air supply conduit, a secondary air pressure control valve comprising:

means defining a vent port through which excess air pressure in the secondary air supply conduit is selectively vented to the atmosphere;

a relief valve member to close the vent port, said relief valve member being responsive to air pressure in said secondary air supply conduit and having an effective area exposed to the air pressure in said secondary air supply conduit to open the vent port;

a spring seat;

a stem slidably extending through said spring seat, the stem being secured at one end thereof to the relief valve member and having a flange at an opposite end thereof;

a coil spring compressed between said spring seat and said flange to urge said relief valve member to its vent port closing position;

said spring seat being spring biased in a direction toward said flange to increase compression of said coil spring; and vacuum servo means for reducing compression of the coil spring in response to increases in intake manifold vacuum when the intake manifold vacuum is lower than a predetermined value and for leaving the relief valve member in a position to open the vent port when the intake manifold vacuum is higher than the predetermined value, the vacuum servo means having a diaphragm dividing an enclosing casing into first and second chambers, respectively, on opposite sides thereof, said first chamber being exposed to ambient atmospheric air, said spring seat being disposed in said second chamber and being connected to said diaphragm; a spring means disposed in said second chamber and biasing said diaphragm and urging said spring seat in a direction toward said flange to cause an increase compression of said coil spring; and said second chamber being connected to said intake system, said diaphragm and said flange being spaced apart such that when the intake manifold vacuum is lower than the predetermined value, said relief valve member is biased in a direction to close the vent port by force due to the compression of said coil spring.

3. In an engine system:

an internal combustion engine having an intake system and an exhaust system;

a secondary air supply conduit communicating with the exhaust system to inject secondary air thereinto;

an air pump discharging secondary air under pressure into the secondary air conduit; and a secondary air pressure control valve comprising:

means defining a vent port through which excess air pressure in the secondary air supply conduit is selectively vented to the atmosphere;

a relief valve member to close the vent port, said relief valve member being responsive to air pressure in said secondary air supply conduit and having an effective area exposed to the air pressure in said secondary air supply conduit to open the vent port;

a seat;

a stem slidably extending through said spring seat, the stem being secured at one end thereof to the relief valve member and having a flange at opposite end thereof;

a coil spring compressed between said spring seat and said flange to urge said relief valve member to its vent port closing position;

said spring seat being spring biased by another spring in a direction toward said flange to increase compression of said coil spring; and vacuum servo means connected to the intake system for reducing compression of the coil spring in response to increased in intake manifold vacuum when the intake manifold vacuum is lower than a predetermined value and for leaving the relief valve member in a position to open the vent port when the intake manifold vacuum is higher than the predetermined value.

4. In an engine system:

an internal combustion engine having an intake system and an exhaust system;

a secondary air supply conduit communicating with the exhaust system to inject secondary air thereinto;

an air pump discharging secondary air under pressure into the secondary air conduit; and a secondary air pressure control valve comprising:

means defining a vent port through which excess air pressure in the secondary air supply conduit is selectively vented to the atmosphere; a relief valve member to close the vent port, said relief valve member being responsive to air pressure in said secondary air supply conduit and having an effective area exposed to the air pressure in said secondary air supply conduit to open the vent port;

a spring seat;

a stem slidably extending through said spring seat, the stem being secured at one end thereof to the relief valve member and having a flange at opposite end thereof;

a coil spring compressed between said spring seat and said flange to urge said relief valve member to its vent port closing position;

said spring seat being spring biased in a direction toward said flange to increase compression of said coil spring; and vacuum servo means for reducing compression of the coil spring in response to increases in intake manifold vacuum when the intake manifold vacuum is lower than a predetermined value and for leaving the relief valve member in a position to open the vent port when the intake manifold vacuum is higher than the predetermined value, the vacuum servo means having a diaphragm dividing an enclosing casing into first and second chambers, respectively, on opposite sides thereof, said first chamber being exposed to ambient atmospheric air, said spring seat being disposed in said second chamber and being connected to said diaphragm; a spring means disposed in said second chamber and biasing said diaphragm and urging said spring seat in a direction toward said flange to cause an increase compression of said coil spring; and said second chamber being connected to said intake system, said diaphragm and said flange being spaced apart such that when the intake manifold vacuum is lower than the predetermined value, said relief valve member is biased in a direction to close the vent port by force due to the compression of said coil spring.

* * * * *